United States Patent [19]

Bly

[11] 3,963,153

[45] June 15, 1976

[54] LEVER ACTUATED CAPTIVE CAN CLOSURE

[76] Inventor: Herbert Arthur Bly, 18 Woodland Drive, East Windsor, N.J. 08520

[22] Filed: Feb. 8, 1974

[21] Appl. No.: 440,739

[52] U.S. Cl. ..... 222/541

[51] Int. Cl.[2] ..... B65D 47/10

[58] Field of Search ..... 220/48, 54, 27; 222/541, 559, 560, 561

[56] References Cited

UNITED STATES PATENTS 2,516,513 7/1950 Gall, Jr. ..... 222/559 X

*Primary Examiner*—Stanley H. Tollberg

[57] ABSTRACT

An easy-opening closure for cans containing beverages and liquids which is actuated by means of a lever and spring fulcrum member affixed to a sliding closure member formed integrally with the can lid by sequential punching and die forming. In the two step opening sequence, the lever is first lifted to break the seal, form a vent, and allow the spring fulcrum element to engage a pivot groove formed in the can lid, after which downward force is applied on the lever to displace the sliding closure member toward the center of the can, guided, and retained by grooves in the side of the opening in the lid. The closure remains attached to the container lid after opening.

5 Claims, 12 Drawing Figures

LEVER ACTUATED CAPTIVE CAN CLOSURE

SUMMARY OF THE INVENTION

The object of the present invention is to provide an improved easy-opening device primarily intended for containers and cans used for beverages and other liquids, which remains "captive" or permanently attached to the container after opening, and in addition is easier and more convenient to use than conventional ring-and-tear-strip closures, providing greater mechanical advantage and allowing the user to employ direct thumb pressure on a relatively large surface area instead of lifting force on a small area pull-ring.

The Lever Actuated Captive Can Closure comprises a lever member with integral fulcrum member, attached to the leading edge of a sliding closure member covering an opening in the container lid.

The sliding closure member is formed integrally in the container lid by a four-stage sequential punching and forming process. This results in the greatest possible economy since no additional material is required to form or guide the closure. The forming process provides guide grooves which seal, retain, and guide the sliding member during lateral displacement.

During the first step of the two step opening sequence, the lever with integral spring fulcrum member is lifted, normally with the user's index finger. This breaks the seal, allows internal pressure in the can to dissipate, and allows the spring fulcrum to move outward and engage a formed pivot groove in the container lid. In the second step of the two step opening sequence, the user applies downward force, normally with the thumb, on the lever face, causing a resultant lever and toggle force to be applied to the sliding closure member, which is displaced toward the center of the can, guided and retained by the grooves in the sides of the opening. At the end of the second step, the lever end is pushed under a retaining bead formed in the can rim which holds the lever firmly against the can lid by frictional force. A permanent vent is retained at the end of the opening in the can lid nearest the center of the can, due to a slightly lower elevation of the semicircular surface of the can lid farthest from the opening. This lower elevation also prevents mechanical interference with the closure end as it is displaced in the second step of the opening sequence.

DRAWINGS

DETAILED DESCRIPTION

The present invention relates to an improved easy-opening closure intended primarily for use on cans containing beverages and other liquids and semiliquids. Your petitioner, Herbert Arthur Bly, has been granted U.S. Pat. No. 3,651,980, Bead Clip Retainer for Can Closure, Mar. 28, 1972; U.S. Pat. No. 3,656,653, Retainer for Can Closure, Apr. 18, 1972; and U.S. Pat. No. 3,727,790, Spring Clip Retainer for Can Closure, Apr. 17, 1973. These patents all relate to a means of affixing the ring-and-tear-strip opening device commonly used on beverage cans to the top rim bead of the can, to provide a convenient and aesthetically satisfactory means of disposing of said ring-and-tear-strip. Further development has led the present invention, which is completely "captive" and permanently affixed to the container before and after opening.

One object of my invention is to provide a convenient easily operated opening device for cans containing beverages and other liquids and semi-liquids, which is designed to remain permanently affixed to the container before and after opening, thus rendering it unnecessary for the user to dispose of the closure separately and thereby avoiding the serious problem of closures being thrown on the ground or otherwise disposed of in an unsightly or hazardous manner such that sharp edges might cause injury if stepped on, or littering of public areas could create an appearance nuisance.

A further object is to provide an opening device more easily actuated than conventional tear strips by means of a lever and integral spring-positioned fulcrum, which affords great mechanical advantage to the user in breaking the seal and withdrawing and thereby opening a sliding closure. A still further object is to provide a sliding closure which is formed integrally and economically in the container lid without use of additional material by sequential punching and die forming in four fundamental stages.

Figure 1:
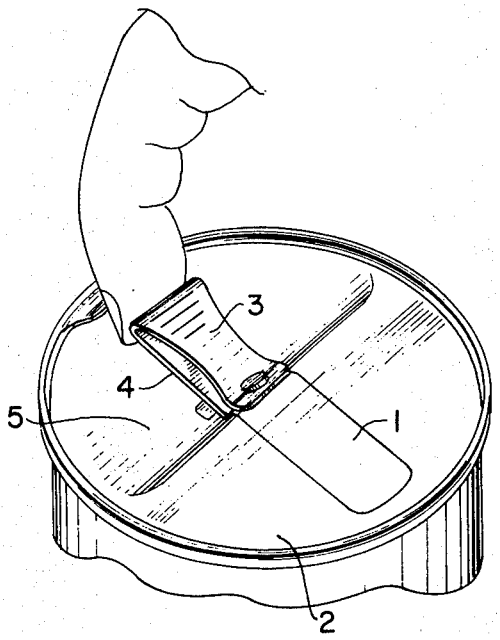
FIG. 1 is a perspective view of a container top showing the Lever Actuated Captive Can Closure in the sealed, unopened condition with the user's index finger in position preparatory to lifting the lever in the first step of the two step opening sequence.

Referring now to FIG. 1, showing my invention in the sealed or unopened condition, a sliding closure, 1, is shown in the closed position in the can lid, 2. A lever member, 3, with spring fulcrum, 4, compressed flat against it, is affixed to the leading edge of closure 1. The lever-and-fulcrum 3 and 4, are shown in the sealed position with both members in close proximity, and substantially parallel, to a slightly depressed surface area 5 of the can lid.

Figure 2:
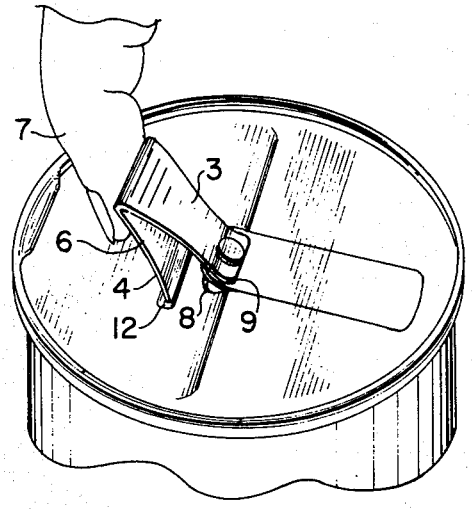
FIG. 2 is a perspective view of a container top showing the lever in position at the completion of the first step of the two step opening sequence, showing the user's thumb in position preparatory to exerting downward force in the second step of the opening sequence.
Figure 3:
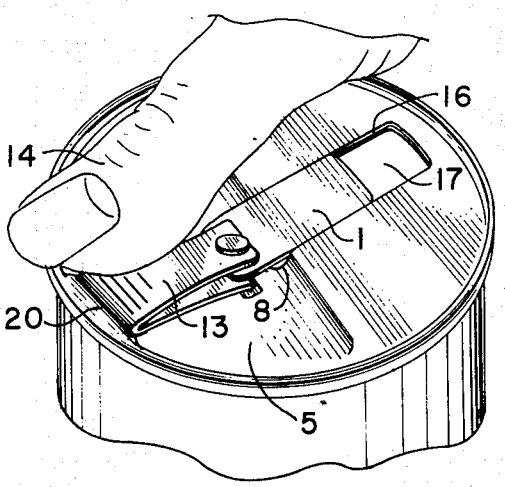
FIG. 3 is a perspective view of a container top showing the Lever Actuated Captive Can Closure in the final, opened position.

FIGS. 2 and 3 depict the two steps of the opening sequence.

In the first step depicted in FIG. 2, the user applies upward force to the lower surface 6 of the lever-and-fulcrum, normally with index finger 7. This breaks the seal and allows any internal gas pressure to escape through the vent opening 8 formed as the leading edge of the closure 9 is bent upward by the lever 10. As the lever 3 is raised, the fulcrum 4 moves outward by spring action and its end snaps into a depression 12 formed in the can lid. In the second or final step of the opening sequence, depicted in FIG. 3, the user applies downward pressure to the lever face 13, normally with the thumb 14, causing a combination lever and toggle resultant force to be applied to the sliding closure 1, pulling it toward the center of the lid and displacing it in integral side grooves 16, to provide an opening 17 in the can. The vent 8 remains entirely functional after opening since air can enter through the space between the sliding closure and the depressed portion 5 of the lid. Said depressed portion 5 also prevents interference between the lid and the sliding closure as it is drawn toward the center of the lid. The lever is held down in close proximity to the can lid, after opening, by frictional force against a rolled-in retaining bead 20 in the can rim.

Figure 4:
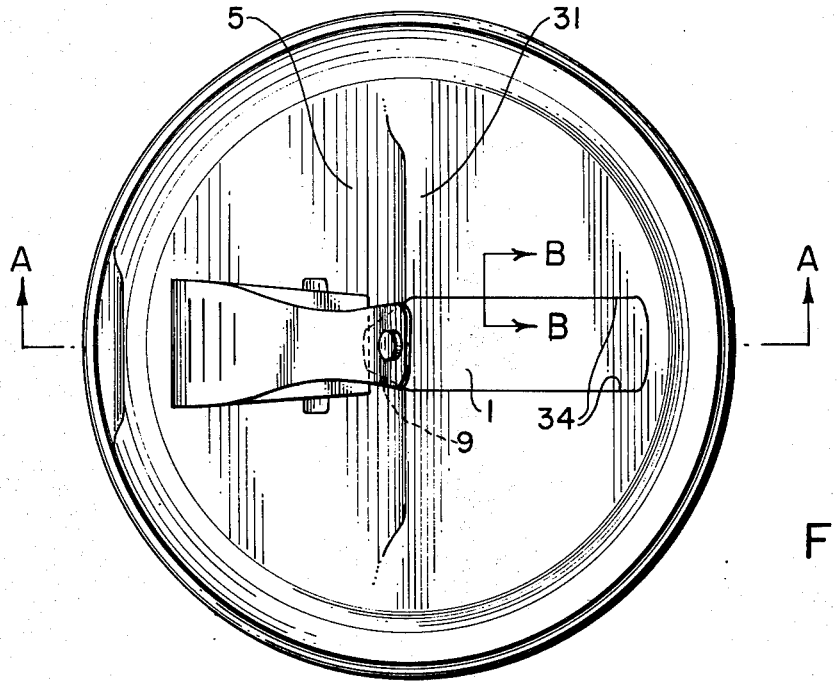
FIG. 4 is a top or plan view of a container top showing the Lever Actuated Can Closure in the sealed, unopened position.
Figure 5:
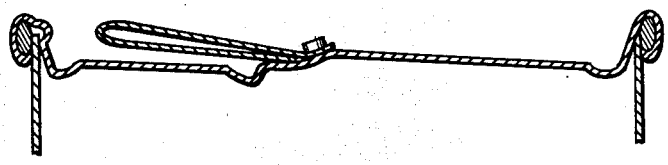
FIG. 5 is a section view A—A through the container top of FIG. 4 showing the Lever Actuated Can Closure in the sealed, unopened position.

In FIG. 4 and section view FIG. 5, the closure is shown in the unopened condition.

Figure 6:
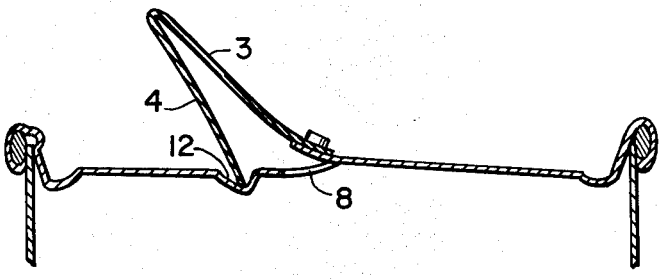
FIG. 6 is the section view of FIG. 5 showing the lever and fulcrum in position after the first step of the 2-step opening sequence.
Figure 7:
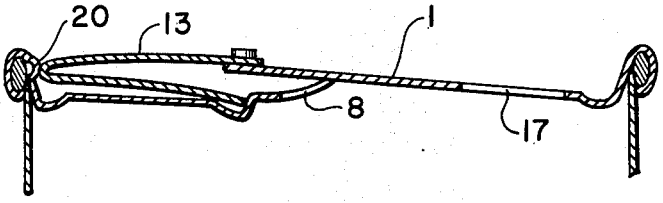
FIG. 7 is the section view of FIG. 5 showing the lever and fulcrum in the final position with the sliding closure displaced in the can lid to form the opening.

In Section view FIG. 6 the lever 3 has been lifted to break the seal, and fulcrum member 4 has moved outward under spring tension until its lower end has engaged the formed depression 12 in the can lid. Vent opening 8 is thus formed to relieve internal gas pressure in the container. In section view FIG. 7, downward force has been exerted on the lever face 13, and the closure 1 has been displaced toward the center of the can lid. Opening 17 has been formed, and vent 8 remains functional to allow air to enter as liquid is poured from opening 17. Lever 13 is retained in the position shown by frictional force of the retaining bead 20 in the can rim. Referring again to FIG. 4, it is of importance to note that the lateral displacement of the closure is made possible without interference by the slight difference of level between surfaces 5 and 31, FIG. 4. The leading edge 9 of closure 1, FIG. 4, is bent upward as the seal is broken in the first step of the opening sequence. The grooved edges 34 of closure 33 are thus cleared of end obstruction and are above the level of surface 5. This difference in level between surfaces 5 and 31 also makes possible the entry of air into vent 8, FIG. 7, after the can is opened.

FIGS. 8 through 12 depict the sequential punching and die forming steps employed to form the sliding closure integrally in the can lid without use of additional material, and concurrently forming retaining and guiding grooves to allow the closure to be displaced laterally to form the opening.

Figure 8:
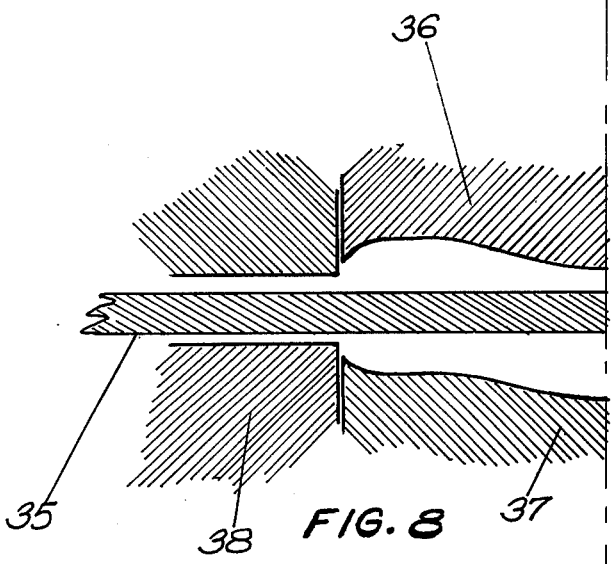
FIG. 8 is an enlarged section view corresponding to Section B.B. of FIG. 4 through a portion of the first of two sets of punching and forming dies used to integrally form the sliding closure member in the container lid, showing the dies in the open position with the container lid in position.
Figure 9:
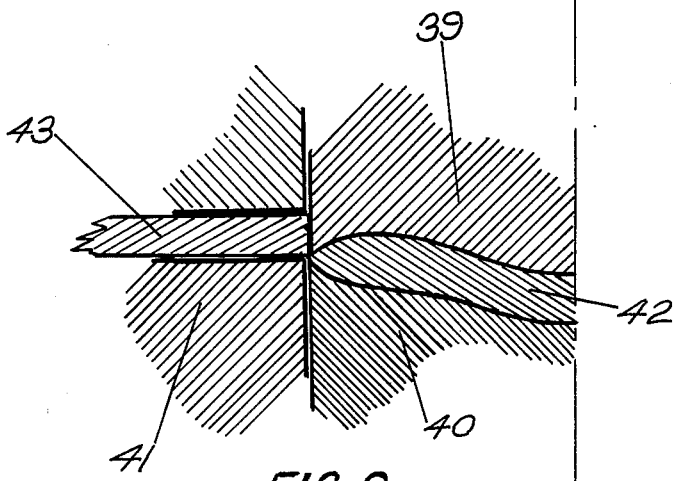
FIG. 9 is the enlarged section view of FIG. 8 with the dies closed and the first two of four stages of the punching and forming process completed.
Figure 10:
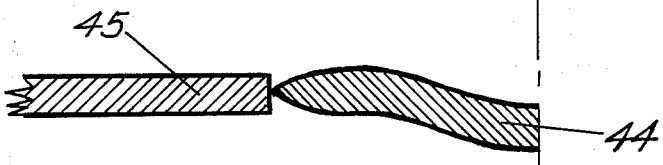
FIG. 10 is an enlarged section view of the container lid shown in FIG. 9 after the sliding member has been repositioned in the container lid opening in the third stage of the forming process.

In FIG. 8 the can lid 35 is shown in position at the first of two sequential die forming stations. Moveable top die 36 and moveable bottom die 37 are shown open. Bottom die 38 is fixed. In FIG. 9, the top 39 and bottom 40 moveable dies have closed and moved downward with respect to the fixed die 41, shearing the closure portion 42 from the lid 43 and simultaneously rounding the edges of the rim of the opening. In FIG. 10, the top and bottom movable dies have moved upward and opened, repositioning the closure portion 44 in the center of the edges of the opening in lid 45.

Figure 11:
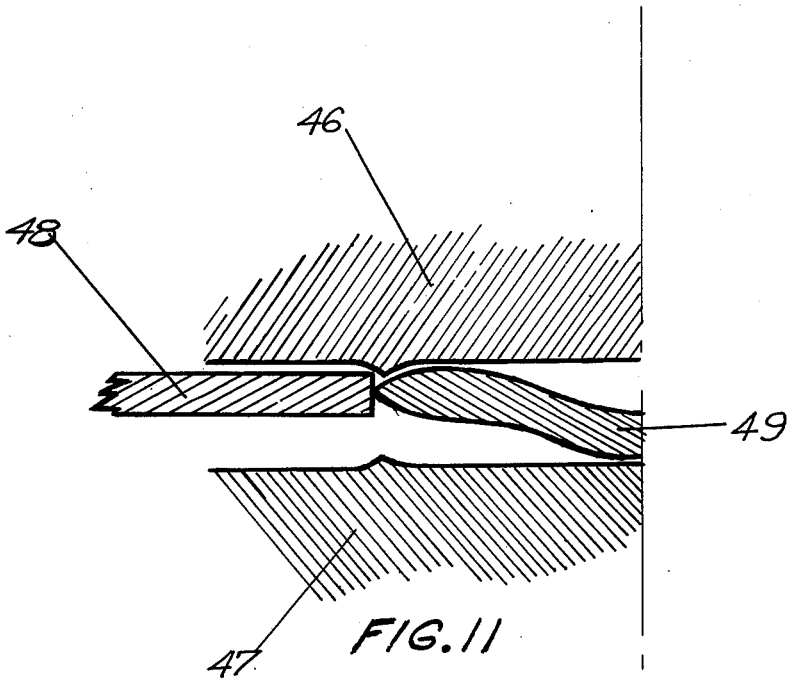
FIG. 11 is an enlarged section view of the container lid shown in FIG. 10 in position between the second of two sets of punching and forming dies.
Figure 12:
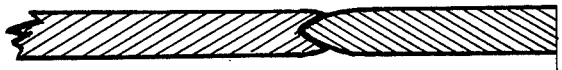
FIG. 12 is an enlarged section view of the container lid and closure shown in FIG. 11 after the fourth and final stage of the forming process.

In FIG. 11, the blank has moved the second of the two sequential die forming stations. The top and bottom dies 46 and 47 are shown immediately prior to closing when the edges of lid 48 will be formed around the rounded edge of the closure 49, as shown in FIG. 12, providing a hermetic seal while simultaneously forming retaining and guiding grooves allowing the closure to be displaced laterally literally with respect to the can lid. During the forming operation, the projected area of the closure is increased due to extrusion of the rounded edges. To compensate for this area increase until the forming is complete, the enlarged surface may be temporarily and elastically held in a concave (or convex) form between the mating die surfaces.

To reduce friction and render the lateral displacement of the closure easier, the lateral sides of the closure may be slightly non-parallel and converging toward the end closest to the can rim.

It is important to note that other means of guiding and retaining the sliding closure may be employed in conjunction with the elements described, for example, a guide or track formed as a separate portion and affixed to the can lid by adhesive bonding, welding, or crimping.

I claim:

1. An easy-opening closure for containers comprising a lever member with an integral spring fulcrum member, said lever member affixed to one end of a sliding closure member formed as an integral part of the container lid and retained therein before, during and after opening by guide grooves engaging the lateral edges of said closure member; a depressed pivot notch in the container lid positioned to receive and engage the free end of said spring fulcrum member when the lever-and-fulcrum is raised; a vent at the end of the closure member attached to the lever member, formed when the lever-and-fulcrum is raised, breaking the closure seal, said elements forming a lever and fulcrum assembly attached to the vented, sliding closure, for the purpose of applying lateral force to displace said closure upon application of downward pressure on the lever face.

2. The closure of claim 1 wherein the sliding member at the end of its travel is not fully withdrawn from the guide grooves of the opening in the container lid and is thereby retained on said lid.

3. The closure of claim 1 wherein a bead is formed in the container rim to retain the lever in its final position against the container lid.

4. The closure of claim 1 in conjunction with a can lid wherein all or a portion of the semi-circular half of the can lid opposite the closure is depressed or offset downward a distance greater than the thickness of the can lid, permitting the closure, after lifting its leading edge upward, to be displaced across the can lid in the direction of the depressed portion without interference.

5. The closure of claim 1 with the lateral sides of the sliding closure member non-parallel and converging toward the end closest to the can rim, to reduce friction and facilitate sliding the closure in a direction toward the center of the can.

* * * * *